US005624632A

United States Patent [19]

Baumann et al.

[11] Patent Number: 5,624,632

[45] Date of Patent: Apr. 29, 1997

[54] ALUMINUM MAGNESIUM ALLOY PRODUCT CONTAINING DISPERSOIDS

[75] Inventors: Stephen F. Baumann; Edward L. Colvin, both of Pittsburgh; Robert W. Hyland, Jr., Oakmont; Jocelyn I. Petit, New Kensington, all of Pa.

[73] Assignee: Aluminum Company of America, Pittsburgh, Pa.

[21] Appl. No.: 381,032

[22] Filed: Jan. 31, 1995

[51] Int. Cl.[6] ..... C22C 21/04

[52] U.S. Cl. ..... 420/544; 148/415; 148/440; 420/543; 420/546; 420/553

[58] Field of Search ..... 420/543, 544, 420/546, 553; 148/415, 440

[56] References Cited

U.S. PATENT DOCUMENTS

| | | | |
|---|---|---|---|
| 3,619,181 | 11/1971 | Willey | 148/415 |
| 4,689,090 | 8/1987 | Sawtell et al. | 148/415 |
| 4,869,870 | 9/1989 | Rioja et al. | 420/532 |
| 4,923,532 | 5/1990 | Zedalis et al. | 148/514 |
| 4,927,470 | 5/1990 | Cho | 148/415 |
| 4,946,517 | 8/1990 | Cho | 148/415 |
| 5,059,390 | 10/1991 | Burleigh et al. | 420/405 |
| 5,066,342 | 11/1991 | Rioja et al. | 148/415 |
| 5,108,519 | 4/1992 | Armanie et al. | 148/689 |
| 5,211,922 | 5/1993 | Yerushalmi et al. | 423/131 |
| 5,213,639 | 5/1993 | Colvin et al. | 148/693 |
| 5,238,646 | 8/1993 | Tarcy et al. | 420/405 |

FOREIGN PATENT DOCUMENTS

| | | |
|---|---|---|
| 1417487 | 7/1993 | Russian Federation . |
| 2001150 | 10/1993 | Russian Federation . |

OTHER PUBLICATIONS

"Grains, Phases, and Interfaces: An Interpretation of Microstructure" by Cyril Stanley Smith (*Institute of Metals Division Lecture, New York Meeting, Feb. 1948*).

"The effect of small additions of scandium on the properties of aluminum alloys" by B.A. Parker, Z.F. Zhou, P. Nolle *Ref: Journal of Materials Science* 30 (1995) 452–458.

"Metallic Structures Used in Aerospace During 25 Years and Prospekts" by Karl–Hein Rendigs *Ref: SAMPE Proceedings, Toulouse, France 1994.*

*Primary Examiner*—David A. Simmons
*Assistant Examiner*—Robert R. Koehler
*Attorney, Agent, or Firm*—Gary P. Topolosky; David V. Radack

[57] ABSTRACT

An aluminum alloy product for use as a damage tolerant product for aerospace applications, including fuselage skin stock. The aluminum alloy composition contains about 3–7 wt % magnesium, about 0.03–0.2 wt % zirconium, about 0.2–1.2 wt % manganese, up to 0.15 wt % silicon and about 0.05–0.5 wt % of a dispersoid-forming element selected from the group consisting of: scandium, erbium, yttrium, gadolinium, holmium and hafnium, the balance being aluminum and incidental elements and impurities.

101 Claims, No Drawings

ALUMINUM MAGNESIUM ALLOY PRODUCT CONTAINING DISPERSOIDS

BACKGROUND OF THE INVENTION

This invention relates to an aluminum alloy product, and more particularly to aluminum alloy products developed for aerospace applications.

Nearly all commercial airplanes have fuselage skins made of AlClad 2024-T3. The base metal, 2024-T3 sheet, has the necessary strength and damage tolerance for aerospace applications, but suffers from susceptibility to pitting and/or intergranular corrosion attack. To compensate for that problem, the base metal is effectively isolated from the environment by a cladding layer, a paint or coating system or a combination of both.

An alcladding process involves combining a thin layer of an aluminum alloy anodic relative to 2024-T3 on both sides of 2024-T3 sheet. These layers act as a barrier and also afford galvanic protection in the 2024-T3 in case the cladding is damaged. In cases where these layers are intentionally removed by machining or chemical milling to save weight, 2024-T3 sheet may be protected with coatings and/or by anodization.

While the above protection systems are generally effective, they have some notable disadvantages. The Alclad layer contributes little with respect to strength, adds weight to the sheet and can act to initiate fatigue cracks. Other coating systems may also add weight and, if damaged, fail to protect 2024-T3 base metal. Surfaces that are anodized are brittle and can act to initiate cracks. Another disadvantage of 2024-T3 sheet is its relatively high density (0.101 $lb/in^3$).

SUMMARY OF THE INVENTION

It is a principal objective of this invention to provide a damage tolerant aluminum alloy product useful for airplane application including fuselage skin, the lower wing sections, stringers and/or pressure bulkheads. The alloys of this invention have a relatively low density, good corrosion resistance and a good combination of strength and toughness so as to obviate cladding, painting and/or other base metal protection systems.

It is another main objective of this invention to provide an aluminum alloy product for damage tolerant applications, such as fuselage skins, that has sufficient strength primarily generated through strain hardening of a generally uniform matrix composition, as opposed to precipitating particles that are electrochemically different from the matrix as in 2024-T3 aluminum.

It is still a further objective of this invention to provide a lower density alloy than 2024-T3 aluminum for potential weight savings in commercial aircraft. With a lower density alloy, increased fuel efficiency and/or increased payload capacity will result. It is yet another object to provide an aluminum alloy system that retains superior performance over the long (generally 20 to 40 year) life of commercial aircraft. It is also an objective of this invention to provide such a material with improved resistance to fatigue crack initiation.

These and other objectives are met or exceeded by the present invention, one embodiment of which pertains to an aluminum alloy product comprising an alloy composition which includes about 3–7 wt % magnesium, about 0.03–0.20 wt % zirconium, about 0.2–1.2 wt % manganese, up to 0.15 wt % silicon and about 0.05–0.5 wt % of a dispersoid-forming element selected from the group consisting of: scandium, erbium, yttrium, gadolinium, holmium and hafnium, the balance being aluminum and incidental elements and impurities. It is preferred that the dispersoid-forming element is scandium. This alloy composition is also preferably zinc-free and lithium-free.

DETAILED DESCRIPTION

For the description of alloy compositions that follows, all references are to weight percentages (wt %) unless otherwise indicated. When referring to any numerical range of values, such ranges are understood to include each and every number and/or fraction between the state range minimum and maximum. A range of about 0.05–0.5 wt % scandium, for example, would include all intermediate values of about 0.06, 0.07, 0.08 and 0.1 wt % all the way up to and including about 0.48, 0.49 and 0.4995 wt % scandium. The same applies to the other elemental ranges set forth below.

The term "substantially free" means having no significant amount of that component purposely added to the alloy composition, it being understood that trace amounts of incidental elements and/or impurities may find their way into a desired end product.

The alloys of the invention are based on the Al-Mg-Sc system and are of sufficient corrosion resistance so as to obviate cladding or other protection systems. Strength in these alloys is primarily generated through strain hardening of a metal matrix which is generally uniform in composition. Combinations of strength and damage tolerance properties sufficient for fuselage skin applications can be obtained by an appropriate selection of composition, deformation processing and subsequent stabilization treatments.

It has been found that the Al-Mg-Sc alloy materials of this invention display adequate tensile strength properties and toughness indicators together with excellent resistance to intergranular (or grain boundary) corrosion. These materials, also demonstrate good resistance to exfoliation attack and excellent stress corrosion cracking ("SCC") resistance during alternate immersion in an NaCl solution tested according to ASTM G-47.

A principal alloy embodiment of this invention comprises an alloy composition which includes about 3–7 wt % magnesium, about 0.03–0.2 wt % zirconium, about 0.2–1.2 wt % manganese, up to 0.15 wt % silicon, and about 0.05–0.5 wt % of a dispersoid-forming element selected from the group consisting of: scandium, erbium, yttrium, gadolinium, holmium and hafnium, the balance being aluminum and incidental elements and impurities. On a more preferred basis, the aluminum alloy composition contains about 3.5–6 wt % magnesium; about 0.06–0.12 wt % zirconium; about 0.4–1 wt % manganese, up to 0.08 wt % silicon and about 0.16–0.34 wt % scandium. Most preferably, the aluminum alloy composition consists essentially of about 3.8–5.2 wt % magnesium; about 0.09–0.12 wt % zirconium; about 0.5–0.7 wt % manganese, up to 0.05 wt % silicon and about 0.2–0.3 wt % scandium. Preferred embodiments of this aluminum alloy are also substantially zinc-free and lithium-free.

While not being limited to any particular theory, it is believed that this invention manages to impart significantly higher strengths and greater corrosion resistance to fuselage skin sheet stock through the addition of certain rare earths or rare earth "act-alikes", such as scandium, by causing rare earth-rich precipitates to form. These precipitates have the ability to store and resist loss of strength arising from plastic deformation. Because of the relatively small size and fine distribution of these particles, recovery and recrystallization of the resulting alloy are also inhibited.

The invention alloy is more temperature resistant than the same alloy devoid of scandium or scandium-like additives. By "temperature resistant", it is meant that a large portion of the strength and structure imparted by working this alloy is retained in the fuselage skin sheet end product, even after exposure to one or more higher temperatures, typically above about 450° F., such as during subsequent rolling operations or the like.

When referring to the main alloying components of this invention, it is understood that a remainder of substantially aluminum may include some incidental, yet intentionally added elements which may affect collateral properties of the invention, or unintentionally added impurities, neither of which should change the essential characteristics of this alloy. With respect to the main alloying elements of this invention, it is believed that magnesium contributes to strain hardening and strength. Zirconium additions are believed to improve the resistance of scandium precipitates to rapid growth. Scandium and zirconium serve yet another purpose. When added to aluminum-magnesium alloys of the type described herein, scandium is believed to precipitate to form a dispersion of fine, intermetallic particles (referred to as "dispersoids"), typically of an $Al_3X$ stoichiometry, with X being either Sc, Zr or both Sc and Zr. $Al_3(Sc, Zr)$ dispersoids impart some strength benefit as a precipitation-hardening compound, but more importantly, such dispersoids efficiently retard or impede the process of recovery and recrystallization by a phenomenon sometimes called the "Zener Drag" effect. [See generally, C. S. Smith, TMS-AIME, 175, 15 (1948).] It is believed to result as follows: Scandium dispersoids are very small in size, but also large in number. They generally act as "pinning" points for migrating grain boundaries and dislocations which must bypass them for metal to soften. Recrystallization and recovery are the principal metallurgical processes by which such strain hardenable alloys soften. In order to "soften" an alloy having a large population of $Al_3(Sc, Zr)$ particles, it is necessary to heat the material to higher temperatures than would be required for an alloy not having such particles. Put another way, when strain-hardened and annealed under identical conditions, a sheet product that contains $Al_3(Sc,Zr)$ dispersoids will have higher strength levels than a comparable alloy to which no scandium was added.

For fuselage skin sheet stock and other aerospace applications, this invention exhibits an ability to resist softening during the high temperature thermal exposures usually needed to roll sheet products. In so doing, the invention alloy will retain some of the strength acquired through rolling. Other scandium-free alloys would tend to retain less strength through rolling, thus yielding a lower strength final product. An added benefit of zirconium is its ability to limit the growth of these $Al_3X$ particles to assure that such dispersoids remain small, closely spaced and capable of producing a Zener Drag effect.

Although it is preferred to limit silicon in the aluminum alloy, it is inevitable that silicon from the refractory will be included. In commercial practice, over 80% of an alloy is obtained from scrap, thus adding to the presence of silicon. The alloy of this invention may contain up to 0.15 wt % silicon with up to 0.08 wt % being preferred and 0.05 wt % or less being most preferred.

In a similar manner, while copper is not an intentional elemental additive, it is a mildly soluble element with respect to this invention. As such, the alloy products described herein may accommodate up to about 0.25 wt % copper or preferably about 0.15 wt % Cu or less.

The aluminum alloy product of this invention is especially suited for applications where damage tolerance is required. Specifically, such damage tolerant aluminum products are used for aerospace applications, particularly fuselage skin, and the lower wing sections, stringers or pressure bulkheads of many airplanes.

The following example is provided to further illustrate the objectives and advantages of this invention. It is not intended to limit the scope of this invention in any manner, however.

EXAMPLE

This example refers to the following main additions to an aluminum based alloy of the present invention:

| | Mg | Mn | Sc | Zr |
|---|---|---|---|---|
| Alloy A | 4.0 | — | 0.23 | 0.10 |
| Alloy B | 4.1 | 0.62 | 0.23 | 0.09 |
| Alloy C | 6.5 | — | 0.23 | 0.09 |

with the balance of each alloy being aluminum, incidental elements and impurities.

All of the aforementioned alloys were direct chill (or "DC") cast as 2½×12 inch ingots and the rolling surfaces scalped therefrom. Alloy A was not homogenized. Alloy B was homogenized for 5 hours at 550° F. followed by 5 hours at 800° F. Alloy C was homogenized for 5 hours at 500° F., then for 6 more hours at 750° F. The scalped ingots were heated to 550° F. for 30 minutes and cross rolled approximately 50% to a nominal thickness of 1 inch. Alloys A and B were then reheated to 550° F. and rolled to a final nominal thickness of 0.1 inch. Mechanical properties for each alloy were then evaluated after a stabilization treatment of 5 hours at 550° F. The ingot of Alloy C was heated to 700° F. and cross rolled to approximately 1 inch thick. This slab was then reheated to 530° F. and rolled to 0.5 inch thickness. The resulting plate from Alloy C was then aged for 15 hours at 500° F. until the electrical conductivity increased to 28.0% of the International Annealed Copper Standard (or "IACS"). Alloy C plate was then heated again to 500° F. and arm rolled to a final thickness of 0.1 inch before being subjected to its final heat treatment of 2 hours at 500° F.

Table I reports the physical, mechanical property and corrosion data available for the foregoing samples of Alloys A, B and C, then compares them with typical values for 2024-T3 aluminum, 6013-T6 aluminum and another potential fuselage skin material known commercially as Alcoa's C-188 product as manufactured in accordance with U.S. Pat. No. 5,213,639, the full disclosure of which is expressly incorporated herein by reference.

The materials of this invention display adequate tensile strength properties. The toughness indicators of Alloy A and B, per center notch toughness and fatigue crack growth (or "FCG") data also strongly indicate that these materials will exhibit good inherent toughnesses as well. The resistance to grain boundary corrosion attack of the present invention is also noteworthy. A standard test for measuring such attacks in Al-Mg base alloys is the ASSET (or ASTM G-66) test after a "sensitization" treatment at 212° F. The subject materials demonstrated good resistance to exfoliation attack in that test with only Alloy B showing any evidence of exfoliation, and even then to just an EA level. By comparison, other materials showed some pitting attack (P)

with minimal blistering. The invention materials also showed excellent SCC resistance during alternate immersion testing using an NaCl solution.

TABLE 1

| Property | | Alclad 2024-T3 Typicals | Alclad C-188 Typicals | 6013-T6 Typicals | Alloy A | Alloy B | Alloy C |
|---|---|---|---|---|---|---|---|
| Strength (ksi) | | | | | | | |
| UTS | L | 66 | 66 | 57 | 56 | 61.4 | 63.7 |
| | LT | 65 | 57 | 57 | 55 | 60.4 | 64.6 |
| | 45 | >68.5 | — | — | 51 | 55.6 | 60.0 |
| TYS | L | 55 | 55 | 53 | 48 | 48.2 | 51.8 |
| | LT | 45 | 45 | 51 | 49 | 48.9 | 53.0 |
| | 45 | >50.4 | — | — | 45 | 45 | 49.5 |
| Elong. | L | 14 | 14 | | 11 | 11.0 | 12.0 |
| | LT | 18 | 18 | 11 | 16 | 16.2 | 12.0 |
| | 45 | >21 | — | — | 22 | 18.8 | 12.0 |
| Density (lb/cu in) | | 0.101 | 0.100 | 0.098 | 0.0958 | 0.0963 | 0.0943 |
| Toughness (ksi Vin) | | | | 6" panel/16 " | 6" panel | 6" panel | |
| Kc | T-L | — | — | 108/147 | 91.4 | 97.2 | |
| Kapp | T-L | — | — | 62/94 | 60.5 | 62.8 | |
| Fatigue | | | | | | | |
| Life at 25 ksi (Kt = 3; R = 0.1) | | — | — | "3 × 10⁴" | "3 × 10⁴" | "2 × 10⁴" | |
| DK at 10(−4) | T-L | 20 | 24 | — | 23/24 | 21 | 15 |
| Modulus (MSi) | | | | | | | |
| Tension | | 10.6 | 10.6 | 9.9 | 10.1 | 10.4 | 10 |
| Corrosion (after 1 wk at 212° F.) | | | | | | | |
| ASSET (24 hrs) ASTM G-66 | | EC | EC | | PA | EA | P |
| Exco (96 hrs) ASTM G-34 | | ED | ED | | N | — | N |
| MASTMASSIS (4 wks) ASTM G-85 | | ED | ED | | N | — | EA |
| SWAAT (2 wks) ASTM G-85 | | — | — | | — | EC | — |
| SCC[1] ASTM G-47 (180 day exposure) | | — | — | | 0/3 | 0/3 | 0/3 |

NOTE:
1. SCC: (#failures/#samples) Transverse Orientation, 75% Y.S. (after 1 wk at 212° F.)

It will be appreciated that an improved aluminum alloy for aerospace applications has been disclosed. This aluminum alloy has low density, good corrosion resistance and a good combination of strength and toughness by comparison to conventional fuselage skin materials. While specific embodiments of the invention have been disclosed, those skilled in the art will appreciate that various modifications and alterations to these details could be developed in light of the overall teachings of this disclosure. Accordingly, the particular arrangements disclosed are meant to be illustrative only and not limiting as to the scope of the invention which is to be given the full breadth of the appended claims and any equivalents thereof.

What is claimed is:

1. An aluminum alloy product comprising an alloy composition which is substantially zinc-free and lithium-free, and includes about 3–7 wt % magnesium, about 0.05–0.2 wt % zirconium, about 0.2–1.2 wt % manganese, up to 0.15 wt % silicon and about 0.05–0.5 wt % of a dispersoid-forming element selected from the group consisting of: scandium, erbium, yttrium, gadolinium, holmium and hafnium, the balance being aluminum and incidental elements and impurities.

2. The aluminum alloy product of claim 1 wherein said alloy contains up to about 0.38 wt % scandium.

3. The aluminum alloy product of claim 2 wherein said alloy contains about 0.16–0.34 wt % scandium.

4. The aluminum alloy product of claim 3 wherein said alloy contains about 0.2–0.3 wt % scandium.

5. The aluminum alloy product of claim 1 wherein said alloy further contains up to about 0.25 wt % copper.

6. The aluminum alloy product of claim 1 wherein said alloy contains about 3.5–6 wt % magnesium.

7. The aluminum alloy product of claim 6 wherein said alloy contains about 3.8–5.2 wt % magnesium.

8. The aluminum alloy product of claim 1 wherein said alloy contains about 0.06–0.12 wt% zirconium.

9. The aluminum alloy product of claim 8 wherein said alloy contains about 0.09–0.12 wt % zirconium.

10. The aluminum alloy product of claim 1 wherein said alloy contains about 0.4–1 wt % manganese.

11. The aluminum alloy product of claim 10 wherein said alloy contains about 0.5–0.7 wt % manganese.

12. The aluminum alloy product of claim 1 wherein said alloy contains up to 0.08 wt % silicon.

13. The aluminum alloy product of claim 12 wherein said alloy contains up to 0.05 wt % silicon.

14. The aluminum alloy product of claim 1 wherein said alloy contains about 3.5–6 wt % magnesium, about 0.06–0.12 wt % zirconium, about 0.4–1 wt % manganese, up to 0.08 wt % silicon and about 0.16–0.34 wt % scandium.

15. The aluminum alloy product of claim 14 wherein said alloy contains about 3.8–5.2 wt % magnesium, about 0.09–0.12 wt % zirconium, about 0.5–0.7 wt % manganese, up to 0.05 wt % silicon and about 0.2–0.3 wt % scandium.

16. A damage tolerant, aerospace part having low density, good corrosion resistance and a good combination of strength and toughness, said aerospace part being made from an alloy composition which is substantially zinc-free and lithium-free, and includes: about 3–7 wt % magnesium; about 0.05–0.2 wt % zirconium; about 0.2–1.2 wt % manganese; up to 0.15 wt % silicon; and about 0.05–0.5 wt % of a dispersoid-forming element selected from the group consisting of: scandium, erbium, yttrium, gadolinium, holmium and hafnium, the balance being aluminum and incidental elements and impurities.

17. The aerospace part of claim 16 wherein said aerospace part is selected from the group consisting of: fuselage skin, a lower wing section, a stringer and a pressure bulkhead.

18. The aerospace part of claim 17 wherein said dispersoid-forming element consists essentially of scandium.

19. The aerospace part of claim 18 wherein said alloy composition contains about 0.2–0.3 wt % scandium.

20. The aerospace part of claim 17 wherein said alloy composition contains about 3.5–6 wt % magnesium.

21. The aerospace part of claim 20 wherein said alloy composition contains about 3.8–5.2 wt % magnesium.

22. The aerospace part of claim 17 wherein said alloy composition further contains up to about 0.25 wt % copper.

23. The aerospace part of claim 17 wherein said alloy composition contains about 0.06–0.12 wt % zirconium.

24. The aerospace part of claim 23 wherein said alloy composition contains about 0.09–0.12 wt % zirconium.

25. The aerospace part of claim 17 wherein said alloy composition contains about 0.4–1 wt % manganese.

26. The aerospace part of claim 25 wherein said alloy composition contains about 0.5–0.7 wt % manganese.

27. The aerospace part of claim 17 wherein said alloy composition contains up to 0.08 wt % silicon.

28. The aerospace part of claim 27 wherein said alloy composition contains up to 0.05 wt % silicon.

29. The aerospace part of claim 17 wherein said alloy composition contains about 3.5–6 wt % magnesium, about 0.06–0.12 wt % zirconium, about 0.4–1 wt % manganese, up to 0.08 wt % silicon and about 0.16–0.34 wt % scandium.

30. The aerospace part of claim 29 wherein said alloy composition contains about 3.8–5.2 wt % magnesium, about 0.09–0.12 wt % zirconium, about 0.5–0.7 wt % manganese, up to 0.05 wt % silicon and about 0.2–0.3 wt % scandium.

31. A damage tolerant airplane component part having low density and good corrosion resistance, strength and toughness properties, said component part consisting essentially of an alloy composition which is substantially zinc-free and lithium-free, and includes about 3–7 wt % magnesium, about 0.05–0.2 wt % zirconium, about 0.2–1.2 wt % manganese, up to 0.15 wt % silicon and about 0.05–0.5 wt % of a dispersoid-forming element selected from the group consisting of: scandium, erbium, yttrium, gadolinium, holmium and hafnium, the balance being aluminum and incidental elements and impurities.

32. The airplane component part of claim 31 wherein said component part is selected from the group consisting of: fuselage skin, a lower wing section, a stringer and a pressure bulkhead.

33. The airplane component part of claim 32 wherein the dispersoid-forming element of said alloy composition consists essentially of about 0.16–0.38 wt % scandium.

34. The airplane component part of claim 33 wherein said alloy composition contains about 0.2–0.3 wt % scandium.

35. The airplane component part of claim 31 wherein said alloy composition further contains up to about 0.25 wt % copper.

36. The airplane component part of claim 32 wherein said alloy composition contains about 3.5–6 wt % magnesium.

37. The airplane component part of claim 36 wherein said alloy composition contains about 3.8–5.2 wt % magnesium.

38. The airplane component part of claim 32 wherein said alloy composition contains about 0.06–0.12 wt % zirconium.

39. The airplane component part of claim 38 wherein said alloy composition contains about 0.09–0.12 wt % zirconium.

40. The airplane component part of claim 32 wherein said alloy composition contains about 0.4–1 wt % manganese.

41. The airplane component part of claim 40 wherein said alloy composition contains about 0.5–0.7 wt % manganese.

42. The airplane component part of claim 32 wherein said alloy composition contains up to 0.08 wt % silicon.

43. The airplane component part of claim 42 wherein said alloy composition contains up to 0.05 wt % silicon.

44. The airplane component part of claim 32 wherein said alloy composition contains about 3.5–6 wt % magnesium, about 0.06–0.12 wt % zirconium, about 0.4–1 wt % manganese, up to 0.08 wt % silicon and about 0.16–0.34 wt % scandium.

45. The airplane component part of claim 44 wherein said alloy composition contains about 3.8–5.2 wt % magnesium, about 0.09–0.12 wt % zirconium, about 0.5–0.7 wt % manganese, up to 0.05 wt % silicon and about 0.2–0.3 wt % scandium.

46. Airplane fuselage skin stock having a good combination of strength toughness and corrosion resistance properties, said fuselage skin stock made from an alloy composition which is substantially zinc-free and lithium-free, and consists essentially of: about 3–7 wt % magnesium; about 0.05–0.2 wt % zirconium; about 0.2–1.2 wt % manganese; up to 0.15 wt % silicon; and about 0.05–0.5 wt % of a dispersoid-forming element selected from the group consisting of: scandium, erbium, yttrium, gadolinium, holmium and hafnium, the balance being aluminum and incidental elements and impurities.

47. The fuselage skin stock of claim 46 wherein the dispersoid-forming element consists essentially of scandium.

48. The fuselage skin stock of claim 47 wherein said alloy composition contains about 0.2–0.3 wt % scandium.

49. The fuselage skin stock of claim 46 wherein said alloy composition further contains up to about 0.25 wt % copper.

50. The fuselage skin stock of claim 46 wherein said alloy composition contains about 3.5–6 wt % magnesium.

51. The fuselage skin stock of claim 50 wherein said alloy composition contains about 3.8–5.2 wt % magnesium.

52. The fuselage skin stock of claim 46 wherein said alloy composition contains about 0.06–0.12 wt % zirconium.

53. The fuselage skin stock of claim 52 wherein said alloy composition contains about 0.09–0.12 wt % zirconium.

54. The fuselage skin stock of claim 46 wherein said alloy composition contains about 0.4–1 wt % manganese.

55. The fuselage skin stock of claim 54 wherein said alloy composition contains about 0.5–0.7 wt % manganese.

56. The fuselage skin stock of claim 46 wherein said alloy composition contains up to 0.08 wt % silicon.

57. The fuselage skin stock of claim 56 wherein said alloy composition contains up to 0.05 wt % silicon.

58. The fuselage skin stock of claim 46 wherein said alloy composition contains about 3.5–6 wt % magnesium, about 0.06–0.12 wt % zirconium, about 0.4–1 wt % manganese, up to 0.08 wt % silicon and about 0.16–0.34 wt % scandium.

59. The fuselage skin stock of claim 58 wherein said alloy composition contains about 3.8–5.2 wt % magnesium, about 0.09–0.12 wt % zirconium, about 0.5–0.7 wt % manganese, up to 0.05 wt % silicon and about 0.2–0.3 wt % scandium.

60. A damage tolerant, aerospace lower wing section having a good combination of strength, toughness and corrosion resistance, said lower wing section made from an alloy composition which is substantially zinc-free and lithium-free, and consists essentially of: about 3–7 wt % magnesium; about 0.05–0.2 wt % zirconium; about 0.2–1.2 wt % manganese; up to 0.15 wt % silicon; and about 0.05–0.5 wt % of a dispersoid-forming element selected from the group consisting of: scandium, erbium, yttrium, gadolinium, holmium, and hafnium, the balance being aluminum and incidental elements and impurities.

61. The lower wing section of claim 60 wherein said alloy composition contains about 0.16–0.38 wt % scandium.

62. The lower wing section of claim 61 wherein said alloy composition contains about 0.2–0.3 wt % scandium.

63. The lower wing section of claim 60 wherein said alloy composition further contains up to about 0.25 wt % copper.

64. The lower wing section of claim 60 wherein said alloy composition contains about 3.5–6 wt % magnesium.

65. The lower wing section of claim 64 wherein said alloy composition contains about 3.8–5.2 wt % magnesium.

66. The lower wing section of claim 60 wherein said alloy composition contains about 0.06–0.12 wt % zirconium.

67. The lower wing section of claim 66 wherein said alloy composition contains about 0.09–0.12 wt % zirconium.

68. The lower wing section of claim 60 wherein said alloy composition contains about 0.4–1 wt % manganese.

69. The lower wing section of claim 68 wherein said alloy composition contains about 0.5–0.7 wt % manganese.

70. The lower wing section of claim 60 wherein said alloy composition contains up to 0.08 wt % silicon.

71. The lower wing section of claim 70 wherein said alloy composition contains up to 0.05 wt % silicon.

72. The lower wing section of claim 60 wherein said alloy composition contains about 3.5–6 wt % magnesium, about 0.06–0.12 wt % zirconium, about 0.4–1 wt % manganese, up to 0.08 wt % silicon and about 0.16–0.34 wt % scandium.

73. The lower wing section of claim 72 wherein said alloy composition contains about 3.8–5.2 wt % magnesium, about 0.09–0.12 wt % zirconium, about 0.5–0.7 wt % manganese, up to 0.05 wt % silicon and about 0.2–0.3 wt % scandium.

74. A damage tolerant, airplane stringer having a good combination of strength, toughness and corrosion resistance, said stringer made from an alloy composition which is substantially zinc-free and lithium-free, and consists essentially of: about 3–7 wt % magnesium; about 0.05–0.2 wt % zirconium; about 0.2–1.2 wt % manganese; up to 0.15 wt % silicon; and about 0.05–0.5 wt % of a dispersoid-forming element selected from the group consisting of: scandium, erbium, yttrium, gadolinium, holmium and hafnium, the balance being aluminum and incidental elements and impurities.

75. The airplane stringer of claim 74 wherein said dispersoid-forming element consists essentially of about 0.16–0.38 wt % scandium.

76. The airplane stringer of claim 75 wherein said alloy composition contains about 0.2–0.3 wt % scandium.

77. The airplane stringer of claim 74 wherein said alloy composition further contains up to about 0.25 wt % copper.

78. The airplane stringer of claim 74 wherein said alloy composition contains about 3.5–3.6 wt % magnesium.

79. The airplane stringer of claim 78 wherein said alloy composition contains about 3.8–5.2 wt % magnesium.

80. The airplane stringer of claim 74 wherein said alloy composition contains about 0.06–0.12 wt % zirconium.

81. The airplane stringer of claim 80 wherein said alloy composition contains about 0.09–0.12 wt % zirconium.

82. The airplane stringer of claim 74 wherein said alloy composition contains about 0.4–1 wt % manganese.

83. The airplane stringer of claim 82 wherein said alloy composition contains about 0.5–0.7 wt % manganese.

84. The airplane stringer of claim 74 wherein said alloy composition contains up to 0.08 wt % silicon.

85. The airplane stringer of claim 84 wherein said alloy composition contains up to 0.05 wt % silicon.

86. The airplane stringer of claim 74 wherein said alloy composition contains about 3.5–6 wt % magnesium, about 0.06–0.12 wt % zirconium, about 0.4–1 wt % manganese, up to 0.08 wt % silicon and about 0.16–0.34 wt % scandium.

87. The airplane stringer of claim 86 wherein said alloy composition contains about 3.8–5.2 wt % magnesium, about 0.09–0.12 zirconium, about 0.5–0.7 wt % manganese, up to 0.05 wt % silicon and about 0.2–0.3 wt % scandium.

88. A damage tolerant, aerospace pressure bulkhead having a good combination of strength, toughness and corrosion resistance, said pressure bulkhead made from an alloy composition which is substantially zinc-free and lithium-free, and consists essentially of: about 3–7 wt % magnesium; about 0.05–0.2 wt % zirconium; about 0.2–1.2 wt % manganese; up to 0.15 wt % silicon; and about 0.05–0.5 wt % of a dispersoid-forming element selected from the group consisting of: scandium, erbium, yttrium, gadolinium, holmium and hafnium, the balance being aluminum and incidental elements and impurities.

89. The aerospace pressure bulkhead of claim 88 wherein said dispersoid-forming element consists essentially of about 0.16–0.38 wt % scandium.

90. The aerospace pressure bulkhead of claim 89 wherein said alloy composition contains about 0.2–0.3 wt % scandium.

91. The aerospace pressure bulkhead of claim 88 wherein said alloy composition further contains up to about 0.25 wt % copper.

92. The aerospace pressure bulkhead of claim 88 wherein said alloy composition contains about 3.5–6 wt % magnesium.

93. The aerospace pressure bulkhead of claim 92 wherein said alloy composition contains about 3.8–5.2 wt % magnesium.

94. The aerospace pressure bulkhead of claim 88 wherein said alloy composition contains about 0.06–0.12 wt % zirconium.

95. The aerospace pressure bulkhead of claim 94 wherein said alloy composition contains about 0.09–0.12 wt % zirconium.

96. The aerospace pressure bulkhead of claim 88 wherein said alloy composition contains about 0.4–1 wt % manganese.

97. The aerospace pressure bulkhead of claim 96 wherein said alloy composition contains about 0.5–0.7 wt % manganese.

98. The aerospace pressure bulkhead of claim 88 wherein said alloy composition contains up to 0.08 wt % silicon.

99. The aerospace pressure bulkhead of claim 98 wherein said alloy composition contains up to 0.05 wt % silicon.

100. The aerospace pressure bulkhead of claim 88 wherein said alloy composition contains about 3.5–6 wt % magnesium, about 0.06–0.12 wt % zirconium, about 0.4–1 wt % manganese, up to 0.08 wt % silicon and about 0.16–0.34 wt % scandium.

101. The aerospace pressure bulkhead of claim 100 wherein said alloy composition contains about 3.8–5.2 wt % magnesium, about 0.09–0.12 wt % zirconium, about 0.5–0.7 wt % manganese, up to 0.05 wt % silicon and about 0.2–0.3 wt % scandium.

* * * * *

UNITED STATES PATENT AND TRADEMARK OFFICE

CERTIFICATE OF CORRECTION

PATENT NO. : 5,624,632

DATED : April 29, 1997

INVENTOR(S) : Stephen F. Baumann et al

It is certified that error appears in the above-identified patent and that said Letters Patent is hereby corrected as shown below:

Col. 9, claim 78, line 54 Delete "3.6" and insert --6--

Signed and Sealed this

Eighteenth Day of November 1997

*Attest:*

Bruce Lehman

BRUCE LEHMAN

*Attesting Officer*

*Commissioner of Patents and Trademarks*